US009456639B2

(12) United States Patent
Aylward

(10) Patent No.: US 9,456,639 B2
(45) Date of Patent: Oct. 4, 2016

(54) ACTIVE WEAR GARMENT

(71) Applicant: Colleen Aylward, Venice, CA (US)

(72) Inventor: Colleen Aylward, Venice, CA (US)

( * ) Notice: Subject to any disclaimer, the term of this patent is extended or adjusted under 35 U.S.C. 154(b) by 0 days.

(21) Appl. No.: 14/598,201

(22) Filed: Jan. 15, 2015

(65) Prior Publication Data

US 2016/0206017 A1 Jul. 21, 2016

(51) Int. Cl.

| | |
|---|---|
| ***A41D 27/20*** | (2006.01) |
| ***A41D 1/08*** | (2006.01) |
| ***A41D 1/22*** | (2006.01) |
| ***A41D 1/00*** | (2006.01) |
| ***A41D 13/00*** | (2006.01) |
| *A41D 7/00* | (2006.01) |

(52) U.S. Cl.

CPC ..... *A41D 1/22* (2013.01); *A41D 1/002* (2013.01); *A41D 13/0012* (2013.01); *A41D 13/0017* (2013.01); *A41D 27/20* (2013.01); *A41D 27/205* (2013.01); *A41D 27/208* (2013.01); *A41D 2400/46* (2013.01); *A41D 2600/10* (2013.01)

(58) Field of Classification Search

CPC .... A41C 3/0057; A41C 3/0064; A41C 3/08; A41C 3/0035; A41D 27/20; A41D 1/22; A41D 2400/60; A41D 2600/10; A41D 27/205; A41D 13/0012; A41D 13/0015; A41D 13/0017; A41D 1/04; A41D 1/08; A41D 2400/46; A41D 27/202; A45F 2003/166

See application file for complete search history.

(56) References Cited

U.S. PATENT DOCUMENTS

| | | | | | |
|---|---|---|---|---|---|
| 2,485,442 | A | * | 10/1949 | Halliday | A41D 13/0012 2/94 |
| 2,508,190 | A | * | 5/1950 | Previdi | A45C 1/04 2/253 |
| 3,248,739 | A | * | 5/1966 | Linden | A41D 27/20 2/227 |
| 4,154,249 | A | * | 5/1979 | Darring | A41C 1/06 450/14 |
| 4,390,024 | A | * | 6/1983 | Williams | A41C 3/0028 450/36 |
| 4,564,957 | A | * | 1/1986 | Scharf | A41B 13/00 2/49.2 |
| 4,602,390 | A | * | 7/1986 | Morera | A41D 27/20 2/247 |
| 4,637,075 | A | * | 1/1987 | Ingrisano | A41D 13/0012 2/102 |
| 4,710,979 | A | * | 12/1987 | Bull | A41B 13/10 2/48 |
| 4,974,762 | A | * | 12/1990 | Boretsky | A45C 1/04 224/148.2 |
| 5,060,833 | A | * | 10/1991 | Edison | A45F 5/00 215/388 |
| 5,075,900 | A | * | 12/1991 | Chittenden | A41D 13/0012 2/102 |
| 5,724,679 | A | * | 3/1998 | Hans | A41D 27/20 2/228 |
| 5,870,777 | A | * | 2/1999 | Hans | A41D 27/20 2/228 |

(Continued)

*Primary Examiner* — Bobby Muromoto, Jr.

(74) *Attorney, Agent, or Firm* — Mark R. Huebscher; TechLaw LLP

(57) ABSTRACT

A fashionable active wear garment with many user convenience features is described herein. The garment includes an upper portion and a lower portion joined by an elastic member that encircles at least a portion of the torso and is used for supporting the wearer during rigorous activity. The garment has several pockets placed in the front and rear, with one pocket located between the shoulder blades of a wearer for vertically inserting a fluid container.

10 Claims, 5 Drawing Sheets

(56) References Cited

U.S. PATENT DOCUMENTS 5,878,441 A * 3/1999 Busker ..... A41D 27/208 2/247
5,913,409 A * 6/1999 Test ..... A41D 13/0012 2/102
5,960,471 A * 10/1999 Burton ..... A41B 13/103 2/104
5,979,722 A * 11/1999 Gonzales ..... B62J 21/00 2/46
5,987,644 A * 11/1999 Mengato ..... A41D 27/202 2/69
6,099,382 A * 8/2000 Wilson ..... A41C 3/0035 2/247
6,176,761 B1 * 1/2001 Underhill ..... A41C 3/0014 450/1
6,517,410 B1 * 2/2003 Underhill ..... A41C 3/0057 450/1
6,626,733 B1 * 9/2003 Knutson ..... A41C 3/0057 2/247
D535,456 S * 1/2007 Anderson ..... D2/841
7,396,274 B2 * 7/2008 Wiegmann ..... A41D 1/22 2/105
D641,954 S * 7/2011 Glass ..... D2/708
D658,352 S * 5/2012 Pinner ..... D2/706
8,312,568 B2 * 11/2012 Marois ..... A41D 27/20 2/115
D674,578 S * 1/2013 Glass ..... D2/731
8,376,808 B2 * 2/2013 Hopkins ..... A41C 3/08 2/69
8,756,717 B2 * 6/2014 Claeys ..... A41D 27/20 2/250
8,898,816 B2 * 12/2014 Highfield ..... A41D 1/002 2/247
2002/0100108 A1 * 8/2002 Stuart ..... A41D 13/0015 2/247
2004/0045325 A1 * 3/2004 Rabinowicz ..... A41D 13/0015 66/176
2005/0005340 A1 * 1/2005 Roux ..... A41C 3/0057 2/69
2005/0075047 A1 * 4/2005 Zagame ..... A41C 3/0035 450/38
2005/0235398 A1 * 10/2005 Yoo ..... A41D 27/20 2/247
2005/0246823 A1 * 11/2005 Groom ..... A41D 27/205 2/247
2006/0085889 A1 * 4/2006 Okajima ..... A41D 1/04 2/77
2006/0206990 A1 * 9/2006 Demus ..... A41D 27/205 2/247
2006/0230490 A1 * 10/2006 Okajima ..... A41D 1/04 2/77
2007/0017943 A1 * 1/2007 Foy ..... A45F 3/14 224/153
2007/0245444 A1 * 10/2007 Brink ..... A41D 1/005 2/69
2007/0271671 A1 * 11/2007 Okajima ..... A41D 1/04 2/69
2008/0047046 A1 * 2/2008 Maier ..... A41D 1/04 2/102
2009/0100561 A1 * 4/2009 Holmes ..... A41D 19/0044 2/16
2009/0270012 A1 * 10/2009 Melarti ..... A41C 1/10 450/8
2009/0300818 A1 * 12/2009 Waite ..... A41D 1/14 2/76
2010/0180361 A1 * 7/2010 Marois ..... A41D 27/20 2/252
2010/0184355 A1 * 7/2010 Kennedy ..... A41C 1/06 450/31
2011/0119800 A1 * 5/2011 Garrido ..... A41D 13/0012 2/2.15
2011/0185471 A1 * 8/2011 Buczkowski ..... A41D 3/00 2/84
2011/0214219 A1 * 9/2011 Miller ..... A41D 27/20 2/115
2012/0142252 A1 * 6/2012 Hopkins ..... A41C 3/08 450/31
2013/0065484 A1 * 3/2013 Ducoulombier ..... A41D 15/002 450/30
2013/0098957 A1 * 4/2013 Lee-Holowka ..... A45F 5/02 224/251
2013/0126540 A1 * 5/2013 Vesterby ..... B65D 37/00 220/737
2014/0101814 A1 * 4/2014 Caulfield ..... A41F 17/00 2/67
2014/0182044 A1 * 7/2014 Cole ..... A41D 27/20 2/69
2015/0133031 A1 * 5/2015 Caden ..... A41C 1/08 450/156
2015/0208737 A1 * 7/2015 Nevins ..... A41D 1/22 2/74
2015/0342270 A1 * 12/2015 Harris ..... A41D 1/06 2/227
2015/0359269 A1 * 12/2015 Rapp ..... A41D 27/20 2/93

* cited by examiner

ACTIVE WEAR GARMENT

FIELD OF THE INVENTION

The present invention relates to active wear garments that are both fashionable and have many user convenience features.

BACKGROUND

This application relates to active wear garments for the modern woman, where exercise apparel and user convenience are uncommon pairings. Often, designers of women's exercise apparel are chiefly concerned with promoting the appearance of the wearer and user comfort. While these features necessary in the eyes of the wearer, pockets, storage, or other user convenience features are an afterthought. User convenience has become particularly necessary in the age of mobile electronic devices because they are an integral part of exercise routines from listening to music, monitoring heart rate, tracking exercise performance statistics, or just talking on the phone. Traditionally, armbands are used to attach a mobile device to one's arm. But these bands are uncomfortable because they promote excess perspiration, cause undesirable tan lines, and prevent easy operation of the mobile electronic device while exercising because it is generally not easy to remove the strap from one's arm. In addition, most exercise apparel does not have storage areas built into the clothing for holding a fluid container, such as a plastic water bottle or a food item, mobile device, smartphone, and so forth. People are relegated to holding the water in their hand while running, in-line skating, playing sports, or engaging in other rigorous activity. Thus, what is needed is a fashionable active wear garment with multiple user convenience features such as pockets for loose items, loops for routing electronic mobile device cords, and a fluid container pocket.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of various embodiments, an active wear garment is provided, the garment comprising: an article of clothing covering at least a portion of a wearer's torso, the article of clothing comprising a front portion and a back portion joined together to define a neckhole and a pair of armholes, wherein the article of clothing comprises a fabric material having sufficient breathability to allow perspiration to escape from a wearer's skin, the front portion comprising an upper section and a lower section abridged by an elastic member that encircles the torso and positioned sufficiently beneath a wearer's breasts to provide support thereof, and the back portion comprising an upper elongated pocket formed between a wearer's shoulder blades for vertically inserting a fluid container or food item, mobile device, smartphone, and so forth, the elongated pocket having a single opening adjacent a wearer's neck, wherein the pocket is lined with a waterproof material, and wherein the pocket has a padding material for cushioning the wearer's back against the fluid container, and a lower group of pockets formed adjacent a wearer's buttocks with at least two pockets having a vertically oriented opening and at least two pockets having a horizontally oriented opening.

In another aspect of various embodiments, an active wear garment is provided, the garment comprising: a front portion and a back portion configured to cover a wearer's torso, each portion made of a breathable fabric for allowing perspiration to escape from a wearer's skin, the front portion and back portion being joined together to define a neckhole and a pair of armholes, wherein the front comprises an upper section, a lower section, and an elastic member abridging the upper and lower section whereby the elastic member encircles the wearer's torso and is positioned sufficiently beneath a wearer's breasts to provide support thereof, the back portion comprising an upper pocket with a padding material for cushioning the wearer's back against items placed within the pocket, a first group of pockets, and a second group of pockets, wherein the upper pocket is attached to the outside of the garment and positioned between the shoulder blades with an opening facing upward adjacent a wearer's neck, and wherein the first group of pockets and second group of pockets are attached to the outside of the garment and positioned adjacent a wearer's buttocks, with the first group of pockets each having a vertically facing opening and the second group of pockets each having a horizontally facing opening.

In still another aspect of various embodiments, an active wear garment is provided, the garment comprising: an article of clothing having a front and a back such that when joined together define a neckhole and a pair of armholes, the front comprising an upper and a lower section abridged by an elastic member encircling a wearer's torso and is positioned sufficiently beneath a wearer's breasts to provide support thereof, the back comprising an upper pocket being vertically oriented for inserting a fluid container, the upper pocket attached to the article of clothing and positioned between a wearer's shoulder blades, a single opening adjacent a wearer's neck, and a padding material for cushioning the wearer against the fluid container, the back further comprising a first group of pockets and second group of pockets attached to the article of clothing adjacent a wearer's buttocks, with the first group of pockets each having a vertically facing opening and the second group of pockets each having a horizontally facing opening.

DETAILED DESCRIPTION

In the following detailed descriptions of various exemplary embodiments, reference is made to the accompanying drawings that form a part hereof, and in which is shown, by way of illustration, specific embodiments that may be practiced. It is to be understood that other embodiments may be utilized and structural changes may be made without departing from the scope of the present disclosure.

Figure 1A:
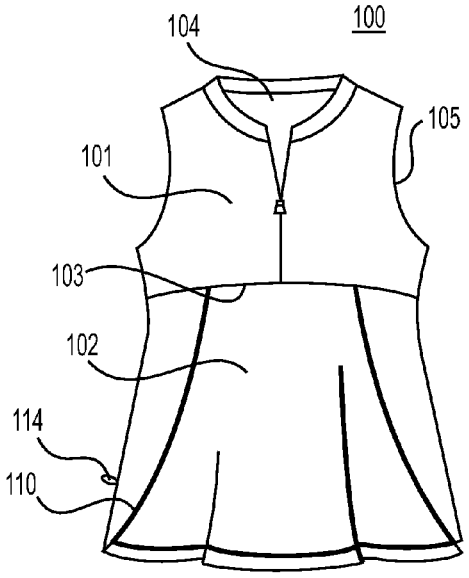
FIG. 1A is a front perspective view of an embodiment active wear garment.
Figure 1B:
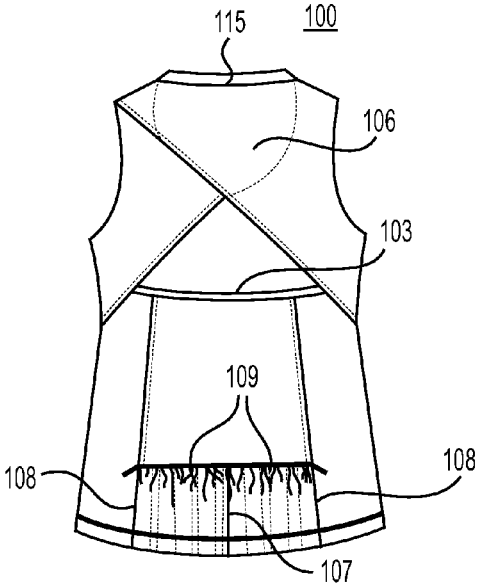
FIG. 1B is a rear perspective view of FIG. 1A.

The present disclosure includes several fashionable embodiments of an active wear garment or article of clothing. Each of the embodiments comprise the similar constituent parts, yet are fashionably unique in each of the variants. In FIG. 1A and FIG. 1B, an embodiment of an active wear garment 100 is shown, where FIG. 1A illustrates the front of the garment 100 and FIG. 1B illustrates the back of the garment 100. The front of the garment 100 may comprise a top portion 101 and a bottom portion 102. The top portion 101 and the bottom portion 102 may be joined with an elastic member 103 that encircles the torso beneath a wearer's breasts when worn to provide support when exercising or other rigorous activity. The top portion 101 may comprise a neckhole 104 and a pair of armholes 105. The neckhole 104 size may be adjustable with a zipper, buttons, hook and loop fabric, elastic or other clothing feature known to those skilled in the art. The article of clothing may be formed from a fabric material having sufficient breathability to allow perspiration to escape from a wearer's skin. Some examples of highly breathable fabrics may include, but are not limited to, cotton, acrylic, and lycra. Elastic fibers may be woven within the fabric to give the wearer a snugly fit, though not too tight to restrict natural movement.

In an embodiment, the garment 100 may comprise a second layer of elastic material attached within the top portion 101 for increased support of the wearer's breasts. Elastic material may also be attached in strategic locations such as the armholes 105, lower extremity of the bottom portion 102, pocket 110, abdomen area, and so forth. The elastic may prevent unwanted movement of the garment 100 during vigorous activity by providing a snugly fit of the wearer's torso and buttocks. The bottom portion 102 may comprise a left, middle, and right portion having at least one pocket 110 with a single mouth. The pocket 110 may be formed on the outer surface of the fabric, or it may be formed so only the mouth is exposed such as between the left section and middle section. At least one loop 114 may be attached to the garment 100 for managing a position of a mobile electronic device cord, such as those used in headphones, earbuds, microphones, and the like. This may be advantageous for preventing swinging arms or other body movement performed during exercise from pulling the cord out of the mobile device or out of the wearer's ears, as an example. A garment wearer may insert a mobile device into a pocket 110 and then route a headphone cord through the loop 114.

The shape of the pocket 110 is aesthetically similar to the general shapes and seams illustrated, which are designed to obscure, as best as possible, the presence of the pocket 110. For example, FIG. 1A has a skirt-like shaped pocket 110 starting from elastic member 103 and flaring outward and down to the bottom of bottom portion 102. Thus, pocket 110 appears as a natural seam or feature of the garment 100. Therefore, various pockets shown in the FIGs. will generally be of a shape or size, with seams that complement the natural design and shape of the garment. For example, FIG. 2B's arrangement of pockets 208,209,211 are shaped to form a curvaceous design that provides both aesthetic appeal and functionality. Of course, while the FIGs illustrate the pockets as having the various geometry, size, and positioning, it is understood that the pockets may be of any geometry, size, or position that facilitates easy access for a wearer.

The back portion of the garment 100 may be comprised of an upper pocket 106 formed between a wearer's shoulder blades when the garment 100 is worn. This location may be particularly advantageous for vertically inserting a fluid container (not shown) or food item, mobile device, smartphone, and so forth because many exercises do not engage the upper spine during movement. Less movement of the fluid translates into more wearer comfort when a fluid container is placed in the pocket 106. Vertical orientation of the pocket 106 also keeps the fluid container upright to minimize spilling or leaking when inserted into the pocket 106. The location between the shoulder blades is also easily accessible by reaching the arm overhead, bending at the elbow, and then grasping the container behind the wearer's neck (see also FIG. 9). The upper pocket 106 may take an elongated shape for accommodating sports drinks, water bottles, and other containers common in the marketplace. The elongated pocket 106 may have a single opening 115 adjacent the neckhole 104. The pocket 106 may be attached to the outside of the garment, which may be advantageous for attaching a preassembled pouch to form the pocket 106 because the pocket may be made of a different material than the garment 100 such as a waterproof material, like neoprene as one example. Of course, other waterproof materials or fabrics known to those skilled in the art may be used. The pocket 106 may also have a padding material for cushioning the wearer's back against impacts from a fluid container or food item, mobile device, smartphone, and so forth. The pocket 106 may also have different elastic characteristics to further prevent the fluid container or food item, mobile device, smartphone, and so forth from moving during exercise.

As illustrated in FIG. 1B, the rear of the garment 100 may have a group of pockets 107 attached to the lower portion of the garment 100. The group 107 may be disposed just above a wearer's buttocks for ease of access. A wearer can easily reach around to insert or remove items from the group of pockets 107. The group 107 may be comprised of a first group of pockets 108 and second group of pockets 109 having horizontal and/or vertical openings. Horizontal pockets 108 may have the mouths open toward the side of the garment 100, whereas vertical pockets 109 may have the mouths open toward the neckhole of the garment 100. The pockets 108,109 may be closeable with a zipper, snap, button, pull strap, elastic band, or other feature known to those skilled in the art. The pockets 108,109 may formed on the outer surface or inner surface of the garment 100. The pockets 108,109 may be made of some fabric as the garment 100, or a different material, in order to secure loose items from moving during exercise. A secondary elastic pocket may be attached within the pockets 108,109,110 to firmly hold a mobile electronic device in place during exercise. This configuration may serve, as one example, to prevent other items placed within the pocket from scratching or otherwise damaging the electronic device during exercise.

Figure 2A:
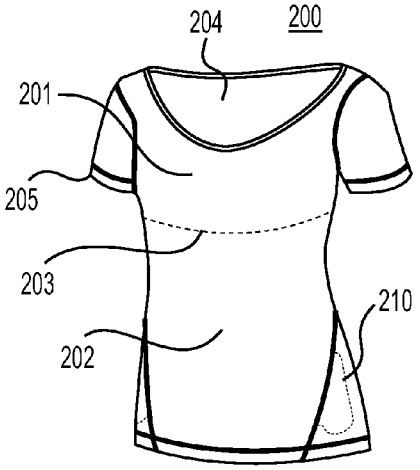
FIG. 2A is a front perspective view of another embodiment active wear garment.
Figure 2B:
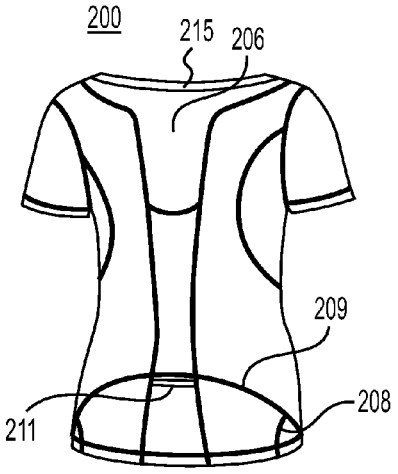
FIG. 2B is a rear perspective view of FIG. 2A.
Figure 3A:
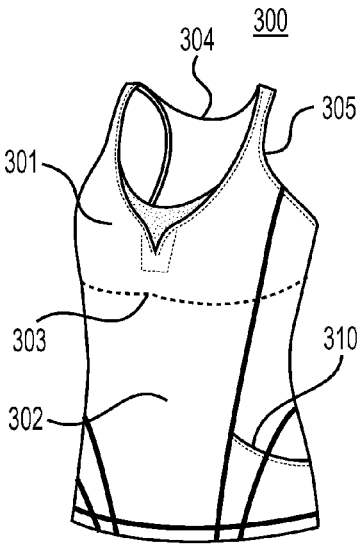
FIG. 3A is a front perspective view of yet another embodiment active wear garment.
Figure 3B:
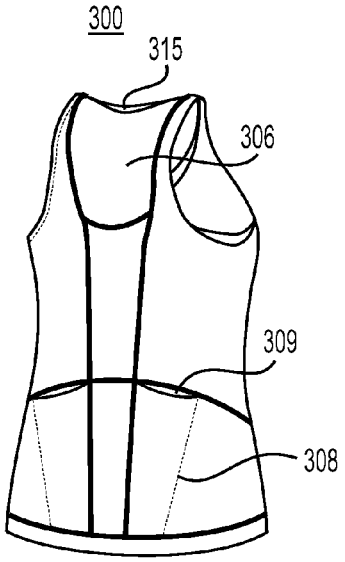
FIG. 3B is a rear perspective view of FIG. 3A.
Figure 4A:
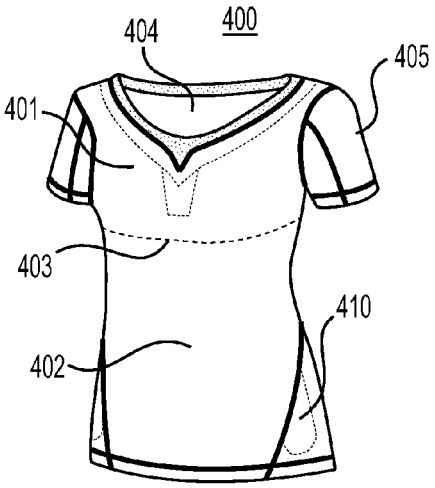
FIG. 4A is a front perspective view of still another embodiment active wear garment.
Figure 4B:
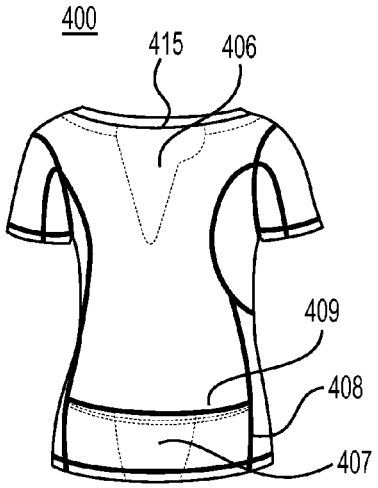
FIG. 4B is a rear perspective view of FIG. 4A.
Figure 5A:
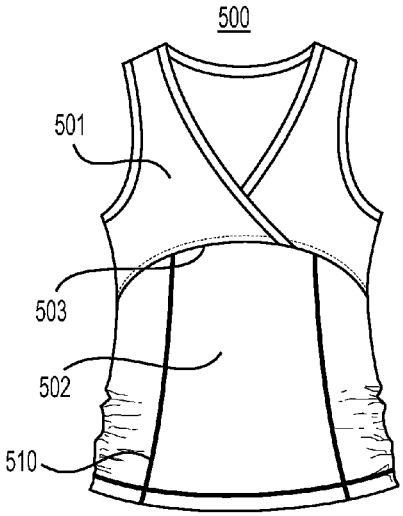
FIG. 5A is a front perspective view of another embodiment active wear garment.
Figure 5B:
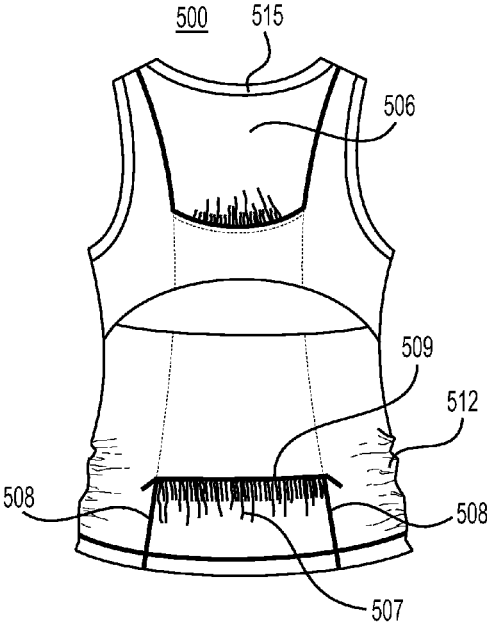
FIG. 5B is a rear perspective view of FIG. 5A.
Figure 6A:
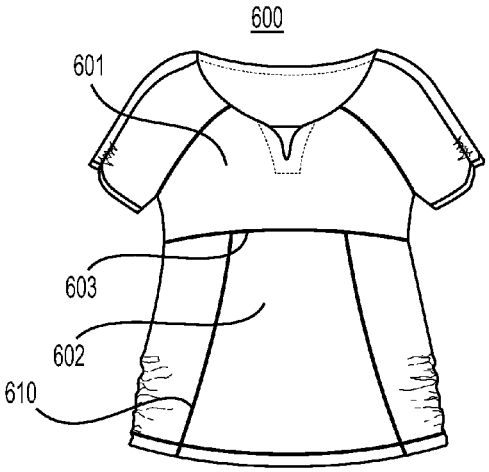
FIG. 6A is a front perspective view of yet another embodiment active wear garment.
Figure 6B:
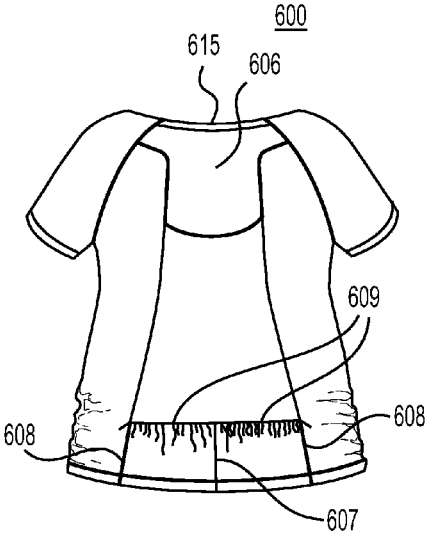
FIG. 6B is a rear perspective view of FIG. 6A.

FIG. 2A and FIG. 2B illustrate another embodiment of an active wear garment 200. As in the aforementioned garment 100, the upper portion 201 and lower portion 202 may be joined with an elastic member 203. The elastic member 203 may not encircle the entire torso as illustrated. The upper portion 201 may have a neckhole 204 and sleeves 205. Though the sleeves 205 are illustrated as short, they may be of a style or length that is of the sleeveless, short, medium, or long variety. The lower portion 202 may have at least one pocket 210 for storing items. The mouth of the pocket 210 may face forward, as depicted, or rearward, or in any direction that may suit a wearer's preference, a functional aspect (prevent items from falling out), or simply the fashion of the garment 200.

A upper pocket 206, with the pocket mouth 215 being disposed adjacent the neckhole 204, may be formed in the rear of the garment 200 in which may be placed a fluid container or food item, mobile device, smartphone, and so forth. A group of pockets 208,209,211 may be located in the lower rear portion of the garment 200. As before, the pockets 208,209,211 may be located just above the wearer's buttocks when the garment 200 is worn in order to minimize movement of any items placed within the pockets 208,209,211 and for ease of access for the wearer's hands. Pockets 208,209,211 may be formed on the outer surface, inner surface, or both of the garment 200. Pocket 211 is illustrated as being formed in the center of the garment 200, which may be ideal for placing a mobile phone or other such similar device.

FIGS. 3A, 3B, 4A, and 4B illustrate still other embodiments of an active wear garment 300,400. Each garment 300,400 may be comprised of upper portions 301,401 and lower portions 302,402 abridged with an elastic member 303,403. Pockets 310,410 may be placed in the lower portion 302,402, as described earlier in the other embodiments. The neckhole 304,404 and armhole 305, 405 may have fashionably unique shapes. Vertically elongate upper pockets 306, 406 are again illustrated with the pocket mouth 315,415 located adjacent the neckhole 304,404. As previously mentioned, the pockets 306,406 may be formed of a different material than the fabric used to form the garment 300,400 in order to provide a waterproof lining, higher elastic stretch, and/or cushioning for the wearer. The rear of the garment 300,400 may be comprised of a group of pockets 308,309,407,408,409, each of which may have horizontal or vertical openings depending on the user's preference.

FIGS. 5A, 5B, 6A, and 6B illustrate yet other embodiments of an active wear garment 500,600. Again, the upper portion 501,601 may be bridged to the lower portion 502, 602 with an elastic member 503,603 for support of the wearer's breasts. The elastic member 503,603 may fully encircle the torso as shown in the garment 500, or the elastic member 503,603 may only partially encircle the torso as shown in the garment 600. As previously mentioned, pockets 510,610 may be incorporated along one or more seams in the front of the garment to enhance aesthetic appeal, yet be functional. Garments 500,600 may utilize the technique known as ruching 512 to gather and sew additional material along the sides of the lower portion 502,602 to accommodate wearers with a larger abdominal area, such as in pregnant women. Rear lower pocket groups 507, 607 may also incorporate ruching to accommodate addition girth in the waist and hip region of the wearer, to maintain a snugly fit and yet allow the wearer to feel unrestricted in their movements. The groups 507,607 may be comprised of a first group of pockets 508,608 and second group of pockets 509,609 having horizontal and/or vertical openings. Horizontal pockets 508,608 may have the mouths open toward the side of the garment 500,600, whereas vertical pockets 509,609 may have the mouths open toward the neckhole of the garment 500,600.

Figure 7A:
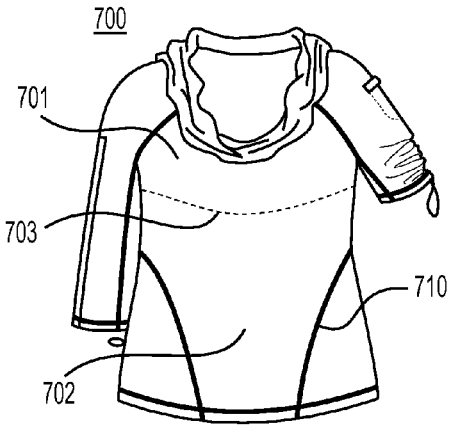
FIG. 7A is a front perspective view of still another embodiment active wear garment.
Figure 7B:
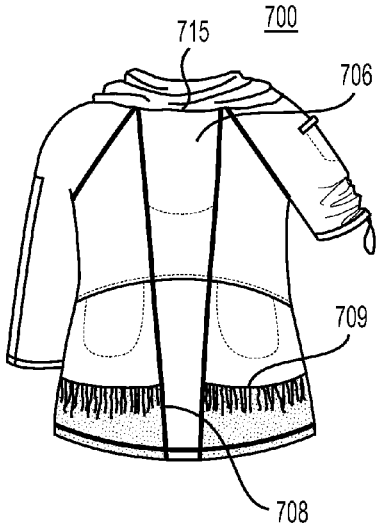
FIG. 7B is a rear perspective view of FIG. 7A.

FIG. 7A and 7B illustrate an embodiment of an active wear garment 700 with extra material attached around the neckhole to create a hood, hijab, scarf, turtleneck, and so forth. As previously mentioned in other embodiments, the garment 700 has front portion and a back portion joined together to define a neckhole and armholes, or sleeves as illustrated. An upper portion 701 and a lower portion 702 abridged with an elastic member 703. The back of the garment 700 may have an elongated pocket 706 located between the shoulder blades for inserting fluid containers such as water bottles and sports drinks or a food item, mobile device, smartphone, and so forth. The mouth 715 of the pocket 706 may be adjacent to the hood, hijab, scarf, turtleneck, and so forth. The rear lower portion of the garment 700 may have a plurality of pockets 708,709 with horizontal and/or vertical openings. Openings of the horizontal pockets 708 may be oriented toward the wearer's spine. Openings of the vertical pocket 709 may be oriented upward to prevent items from falling out. Further, the pockets 708,709 may be closeable with a zipper, strap, button, snap, elastic cord, or other means known to those skilled in the art.

Figure 8A:
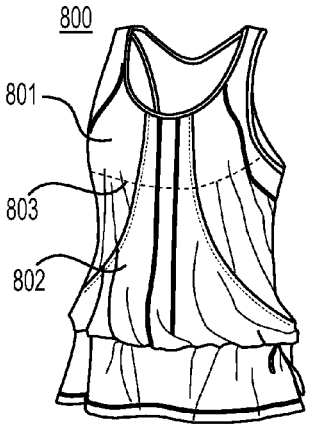
FIG. 8A is a front perspective view of an embodiment active wear garment.
Figure 8B:
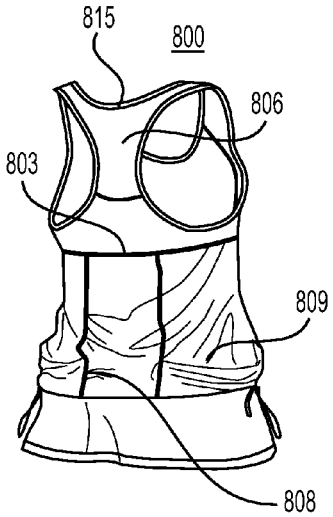
FIG. 8B is a rear perspective view of FIG. 8A.

FIG. 8A and 8B illustrate another embodiment of an active wear garment 800 similar in most respects to the aforementioned embodiments. The upper portion 801 and lower portion 802 may be abridged with an elastic member 803 that fully encircles the torso. The lower portion 802 may hang loosely on the wearer to appeal to different wearer's preferences such as to promote a more casual look and comfort. The back portion of the garment 800 has an upper pocket 806 with a mouth 815 oriented upward for retaining a fluid container or food item, mobile device, smartphone, and so forth, and lower pockets 808,809 for storing items during exercise such as keys, a mobile phone, lip balm, food, and so forth.

Figure 9:
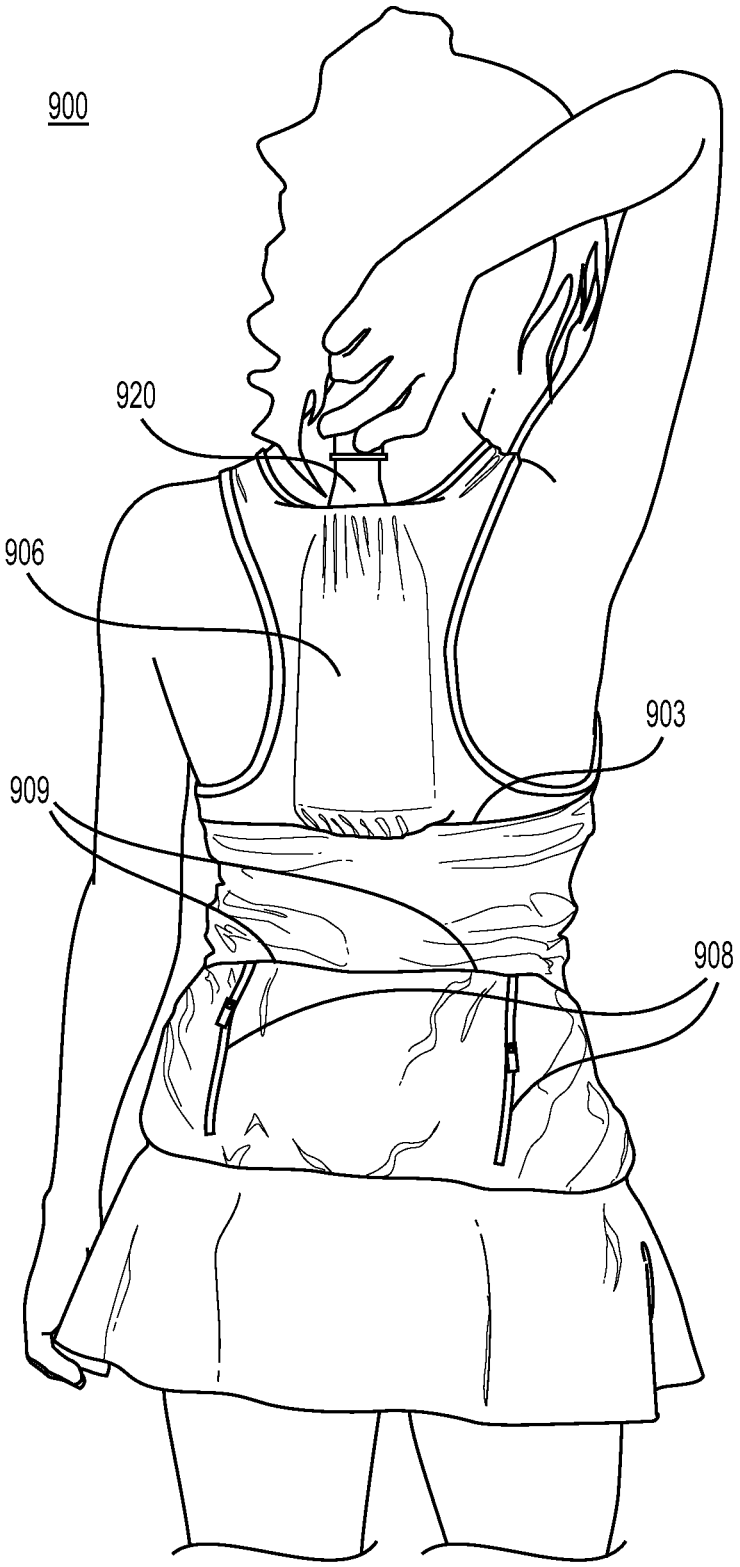
FIG. 9 is a rear perspective view of an active wear garment user accessing a fluid container within the upper rear pocket.

FIG. 9 illustrates another embodiment of an active wear garment 900 with the wearer demonstrating the accessibility of a fluid container 920 when inserted into the upper elongated pocket 906. The elastic member 903 may serves to limit the insertion length of the fluid container 920 in addition to bridging the upper portion and lower portion, and giving support to the wearer's breasts. The lower set of pockets 908,909 may be located just above the wearer's buttocks. The horizontal pockets 908 may have separate openings, shown here as closeable with a zipper, but may not be separated in the middle. This configuration may allow access to items placed within the pocket 908 from either opening. Vertical pockets 909 are shown with their mouths oriented upward. As with the horizontal pockets 908, items placed within the vertical pockets 909 may be accessible through either opening.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A female active wear garment with obscured pockets, comprising:

an article of outer wear clothing covering at least a portion of a wearer's torso, the article of clothing comprising a front portion and a back portion joined together to define a neckhole and a pair of armholes, wherein the article of clothing comprises an elastic fabric material having sufficient breathability to allow perspiration to escape from a wearer's skin while snugly fitting the wearer's torso, the front portion comprising a) an upper section and a lower section abridged by an elastic member that encircles the torso and positioned sufficiently beneath a wearer's breasts to provide support thereof, wherein the lower section comprises b) a left section, a middle section, and a right section, wherein the left section is joined to the middle section with a vertically oriented seam, and the right section is joined to the middle section with a vertically oriented seam, and wherein at least one pocket is formed in the middle section with an opening to the pocket positioned to coincide with the vertically oriented seam to obscure the presence of the pocket, the back portion comprising a) an upper elongated pocket formed between a wearer's shoulder blades for vertically inserting a fluid container, the elongated pocket having a single opening adjacent a wearer's neck, wherein the pocket is lined with a waterproof material, and wherein the pocket has a padding material for cushioning the wearer's back against the fluid container, and b) a lower group of pockets formed with at least one seam adjacent a wearer's buttocks with at least two pockets having a vertically oriented opening and at least two pockets having a horizontally oriented opening, wherein each of the lower group of pockets openings coincide with the seams to complement the natural design and shape of the female body for obscuring the presence of each of the pockets.

2. The active wear garment of claim 1, the lower group of pockets with each horizontally oriented opening having a zipper.

3. The active wear garment of claim 1, further comprising an elastic pocket attached to the back portion and positioned within at least one of the lower group of pockets for securely retaining a mobile electronic device.

4. The active wear garment of claim 1, wherein the armholes are formed from the style selected from the group consisting of sleeveless, short sleeve, medium sleeve, and long sleeve.

5. The active wear garment of claim 1, wherein the front portion lower section comprises ruching.

6. A female active wear garment with obscured pockets, comprising:

a front portion and a back portion configured to cover a wearer's torso, each portion made of a breathable elastic fabric for allowing perspiration to escape from a wearer's skin while snugly fitting the wearer's torso, the front portion and back portion being joined together to define a neckhole and a pair of armholes, wherein the front portion comprises a) an upper section, a lower section, and an elastic member abridging the upper and lower section whereby the elastic member encircles the wearer's torso and is positioned sufficiently beneath a wearer's breasts to provide support thereof, wherein the lower section comprises b) a left section, a middle section, and a right section, wherein the left section is joined to the middle section with a vertically oriented seam, and the right section is joined to the middle section with a vertically oriented seam, and wherein at least one pocket is formed in the middle section with an opening to the pocket positioned to coincide with the vertically oriented seam to obscure the presence of the pocket, the back portion comprising a) an upper pocket with a padding material for cushioning the wearer's back against items placed within the pocket, wherein the upper pocket is attached to the outside of the garment and positioned between the shoulder blades with an opening facing upward adjacent a wearer's neck, and b) a first group of pockets, and a second group of pockets, wherein the first group of pockets and second group of pockets are attached to the garment with at least one seam and positioned adjacent a wearer's buttocks, with the first group of pockets each having a vertically facing opening and the second group of pockets each having a horizontally facing opening, wherein each of the first group of pockets openings and second group of pockets openings coincide with the at least one seam to complement the natural design and shape of the female body for obscuring the presence of each of the pockets.

7. The active wear garment of claim 6, the lower group of pockets with each horizontally oriented opening further comprising a zipper.

8. The active wear garment of claim 6, wherein the back portion upper pocket comprises a waterproof liner.

9. The active wear garment of claim 6, wherein the armholes are formed from the style selected from the group consisting of sleeveless, short sleeve, medium sleeve, and long sleeve.

10. A female active wear garment with obscured pockets, comprising:

an article of clothing having a front and a back made of a breathable elastic fabric for allowing perspiration to escape from a wearer's skin while snugly fitting the wearer's torso such that when joined together define a neckhole and a pair of armholes, the front comprising a) an upper and a lower section abridged by an elastic member encircling a wearer's torso and is positioned sufficiently beneath a wearer's breasts to provide support thereof, b) wherein the lower section comprises a left section, a middle section, and a right section, wherein the left section is joined to the middle section with a vertically oriented seam, and the right section is joined to the middle section with a vertically oriented seam, and wherein at least one pocket is formed in the middle section with an opening to the pocket positioned to coincide with the vertically oriented seam to obscure the presence of the pocket, the back comprising a) an elastic upper pocket being vertically oriented for inserting a fluid container, the upper pocket attached to the article of clothing and positioned between a wearer's shoulder blades, a single opening adjacent a wearer's neck, and a padding material for cushioning the wearer against the fluid container, b) the back further comprising a first group of pockets and second group of pockets attached to the article of clothing with at least one seam adjacent a wearer's buttocks, with the first group of pockets each having a vertically facing opening and the second group of pockets each having a horizontally facing opening, wherein each of the first group of pockets openings and second group of pockets openings coincide with the at least one seam to complement the natural design and shape of the female body for obscuring the presence of each of the pockets.

* * * * *